United States Patent [19]

Bergmann et al.

[11] 4,335,590

[45] Jun. 22, 1982

[54] GUIDEBAR SHOGGING LINKAGE ARRANGEMENT FOR WARP KNITTING MACHINES

[75] Inventors: Gerhard Bergmann, Obertshausen; Heinz Wade, Rodgau, both of Fed. Rep. of Germany

[73] Assignee: Karl Mayer Textilmaschinenfabrik GmbH, Obertshausen, Fed. Rep. of Germany

[21] Appl. No.: 165,020

[22] Filed: Jul. 1, 1980

[30] Foreign Application Priority Data

Jul. 4, 1979 [DE] Fed. Rep. of Germany ..... 2926929

[51] Int. Cl.[3] ..... D04B 23/00

[52] U.S. Cl. ..... 66/207

[58] Field of Search ..... 66/203, 204, 207, 205

[56] References Cited

U.S. PATENT DOCUMENTS 3,478,543 11/1969 Faninger ..... 66/205
3,653,232 4/1972 Walter ..... 66/205

FOREIGN PATENT DOCUMENTS 90683 2/1897 Fed. Rep. of Germany ..... 66/207
204446 11/1908 Fed. Rep. of Germany ..... 66/207
210865 6/1909 Fed. Rep. of Germany ..... 66/207
265540 10/1913 Fed. Rep. of Germany ..... 66/207
489059 1/1930 Fed. Rep. of Germany ..... 66/207

*Primary Examiner*—Ronald Feldbaum
*Attorney, Agent, or Firm*—Omri M. Behr

[57] ABSTRACT

A guidebar shogging linkage arrangement for warp knitting machines includes a pair of shogging guides, each having slider bars movable in a longitudinal direction pivotably connected to a common keying element by means of a pair of elongated levers. A shogging lever has its position determined alternately by the position of the first slider bar and then the second slider bar which position is programmed into the shogging guide by means of a predetermined program fed to a jacquard mechanism. The shogging lever is capable of moving the guidebar in fixed increments parallel to the needle bar. The shogging lever also includes a means for adjusting the amount of incremental shogging distance for the same incremental setting of the guide apparatus. A compensating drive means may also be coupled to the shogging lever to compensate for arcuate movements of the shogging lever. Alternating driving means are coupled to the shogging lever to enable alternate selection of the slider bar positions to effect the amount of movement of the shogging lever.

5 Claims, 2 Drawing Figures

GUIDEBAR SHOGGING LINKAGE ARRANGEMENT FOR WARP KNITTING MACHINES

BACKGROUND OF THE INVENTION

1. Field of the Invention

The present invention relates to guidebar shogging linkage arrangements, and in particular, to a guidebar shogging linkage arrangement which permits the use of one shogging guide for a plurality of needle spacings and is capable of compensating for the arcuate movement of the shogging lever.

2. Discussion of the Relevant Art

Numerous shogging guide devices are known in the art. Some of these devices utilize a pair of slider bars connected to a changeover drive mechanism which selects either one slider bar or the other slider bar to determine the position of the shogging lever. Generally, these steerable elements are equipped with a return spring so that the spring energy must be overcome to set the desired displacement of the slider bar. One of these devices is disclosed in the German Offenlegungsschrift No. 2,056,325 dated May 25, 1972. Disclosed therein is a keying element formed as a roller which rolls on the steering surface provided at one end of both of the slider bars. The keying roller is affixed to the shogging lever and is pressed against the steering surface by a return spring attached to the guidebar. In order to alternate the keying roller with one or the other steering surface, the shogging lever may either be fixedly pivoted and the guide for the slider made movable upwardly or downwardly, or the lever itself may be mounted on an axis which is movable upwardly or downwardly. The shogging guide or steering arrangement includes multi-position cylinders having adjustable stops. A coupling linkage connects one end of the slider bar and is pressed against the adjustable stops by means of a return spring. In addition, ratchet teeth are provided which hook into a ratchet detent in the slider bar in order to alternately stop or release the slider bars for a new setting.

Utilizing a two-position shogging guide arrangement permits a much higher rate of speed to be accomplished for a given pattern selection and thus is vastly superior to shogging pattern drives which have only one guide arrangement. The double guide arrangement permits one slider bar to be adjusted to a new setting while the other slider bar is operatively connected to the guidebar for the displacement thereof. Unfortunately, however, there is a substantial mechanical loss which must be overcome because of the required locking arrangement needed for the slider bars and the fact that the driving force for the guiding arrangement requires overcoming the return force of the return springs which act upon the slider bars. Having to overcome the return springs introduces a limitation in the speed of operation and requires additional energy to overcome the spring forces.

Other types of shogging guide mechanisms have been utilized for warp knitting machines such as that disclosed in a textbook entitled, "Warp Knitting Technology" by D. F. Paling first published in 1952 and reprinted in 1970 by the Columbine Press (Publishers Limited). Another improved shogging or steering guide apparatus is disclosed in U.S. patent application Ser. No. 165,040, filed on July 1, 1980 and entitled "Guidebar Shogging Guide Apparatus for Warp Knitting Machines."

The present invention overcomes the shortcomings found in the prior art by utilizing a simplified guide apparatus which utilizes a pair of slider bars coupled to a keying element fixedly positioned on a shogging lever to control the displacement of the guidebar. The keying element's position is alternately selected from one or the other of the slider bars. The keying element may be positioned at different settings on the shogging lever thereby permitting the guidebar to be moved different incremental distances for the same incremental distance moved by the slider bar. A simple means for providing a changeover from the position of one slider bar to the other slider bar is disclosed. The instant apparatus does not operate against the forces of return springs and therefore is capable of much higher speeds of operation.

SUMMARY OF THE PRESENT INVENTION

Therefore, it is an object of the present invention to provide a guidebar shogging linkage arrangement for use on warp knitting machines that is reliable and capable of operating at high speeds.

It is another object of the present invention to provide a guidebar shogging linkage arrangement which is capable of compensating for the non-linear movement of the shogging lever. It is yet a further object of the present invention to provide a shogging linkage arrangement that is capable of providing different proportional increments for the same shogging guide setting.

The guidebar shogging linkage arrangement, according to the principles of the present invention, for warp knitting machines having a guidebar, a needle bar with a plurality of equally spaced needles disposed thereon, a shogging guide apparatus for shogging the guidebar in predetermined increments parallel to the needle bar, and a power driving source operatively coupled thereto, comprises in combination a pair of guide means, each of the guide means has a means for providing a predetermined incremental distance in a longitudinal direction. A pair of slider bars are included, each of the slider bars are movable in the longitudinal direction and operatively coupled to one of the pair of guide means. The position of each of the slider bars in the longitudinal direction is determined by the guide means being set to a particular distance according to a predetermined program. Shogging lever means is operatively coupled to the guidebar for moving the guidebar in a direction parallel to the needle bar. First and second elongated lever means are included. One end of the first lever means is pivotably connected to one of said slider bars. One end of said second lever means is pivotably connected to the other of the slider bars. A keying element means is positioned in intimate contact with the shogging lever means and has a pivot hinge adapted to pivotably retain the other ends of the first and second lever means about a common axis. The shogging lever means is driven by the power driving source with its position alternately related to the longitudinal position of the first and second slider bar.

The foregoing and other objects and advantages will appear from the description to follow. In the description reference is made to the accompanying drawing which forms a part hereof, and in which is shown by way of illustration a specific embodiment in which the invention may be practiced. This embodiment will be described in sufficient detail to enable those skilled in the art to practice the invention and it is to be understood that other embodiments may be utilized and that structural changes may be made without departing from the scope of the invention. The following detailed description is, therefore, not to be taken in a limiting sense, and the scope of the present invention is best defined by the appended claims.

BRIEF DESCRIPTION OF THE DRAWINGS

In order that the invention may be more fully understood, it will now be described, by way of example, with reference to the accompanying drawing in which.

DESCRIPTION OF THE PREFERRED EMBODIMENT

Figure 1:
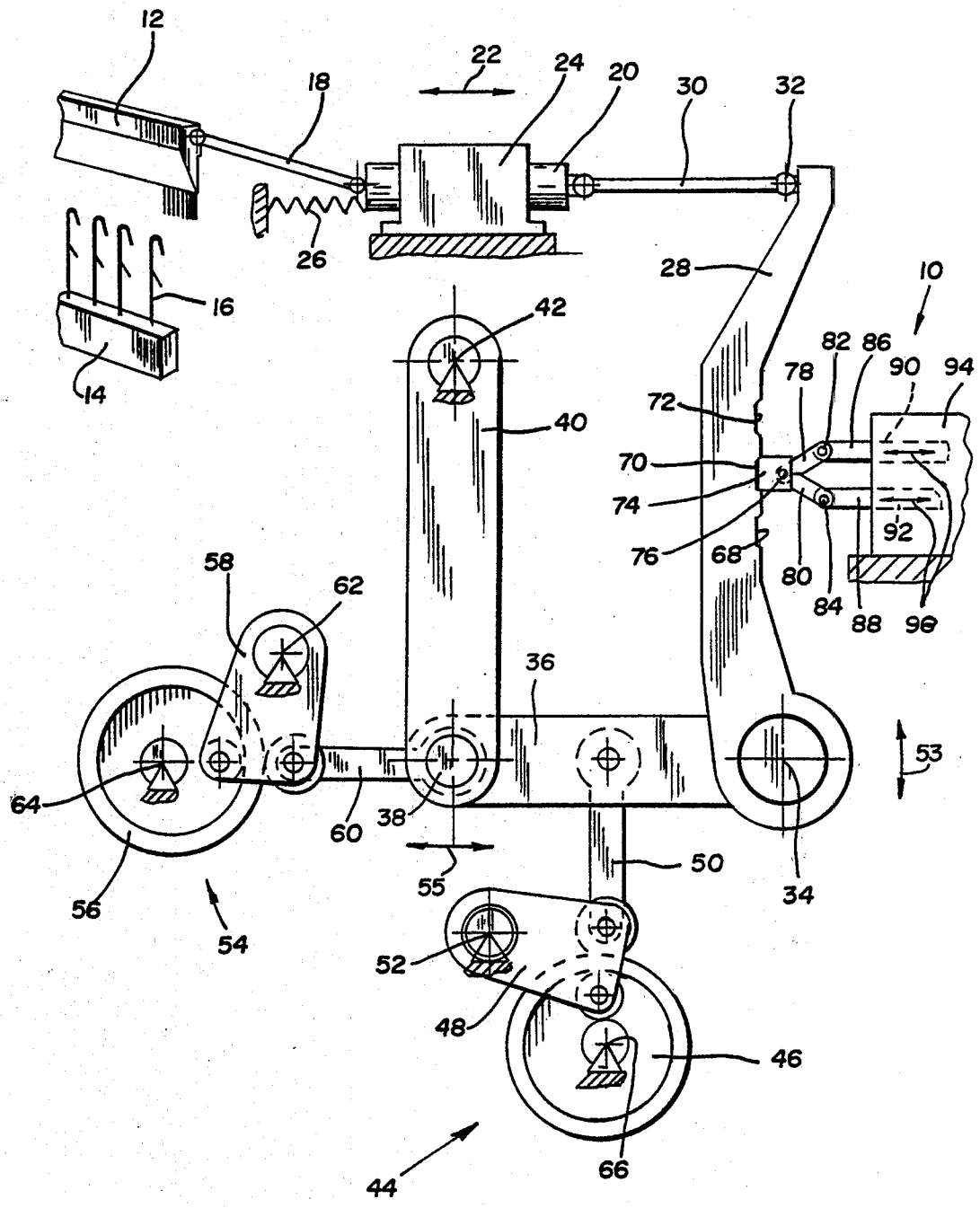
FIG. 1 is a schematic side view of the linkages coupling the guide apparatus to the guidebar, according to the principles of the present invention.

Referring now to the figures, and in particular to FIG. 1, which is a partial schematic side view of a warp knitting machine having a guidebar shogging guide apparatus 10 operatively coupled to a guidebar 12 that is caused to be displaced in fixed incremental units in accordance with a predetermined program. The guidebar 12 is of conventional design and is similar to that disclosed in the text entitled: "Warp Knitting Technology" by D. F. Paling which is incorporated herein in its entirety. The warp knitting machine, not shown, includes a needle bar 14 which has a plurality of needles 16 affixed therein in a conventional manner. The pattern drive or guidebar shogging guide apparatus 10 controls the displacement of the guidebar 12 relative to the needles 16. Guidebar 12 is connected, via a steering rod 18, which is flexibly coupled to a shaft 20 that moves back and forth in a lateral or transverse direction, as shown by arrow 22, in a fixed housing 24. This arrangement is biased to a zero or set position by a return spring 26. The shaft 20 is connected to shogging lever 28, via a connecting rod 30 acting upon a ball joint 32 which is rotatable about a pivot axis or shaft 34. Pivot axis 34 is connected, via a connecting rod 36, to pivot point 38 which is disposed at the opposite end thereof. Pivot point 38 has support lever 40 affixed thereto. Support lever 40 is pivotable about axis 42 at its opposite end.

An alternating drive means 44 that includes an eccentric cam disc 46 and a guide lever 48 coupled thereto is also coupled, via pushrod 50, to connecting rod 36. The far end of guide lever 48 is pivotally connected to pivot point 52 thereby providing motion to the pivot axis 34 in the direction of arrow 53. The alternating drive means is coupled, in a conventional manner to the power driving source, not shown.

A compensating drive means 54 that includes an eccentric cam 56 coupled thereto and a guide lever 58 is similarly coupled to connecting rod 36, via a pushrod 60. The far end of guide lever 58 is pivotable around an axis 62. Eccentric cam 56 rotates about axis 64 and eccentric cam 46 rotates about axis 66. The compensating drive means 54 is also coupled to the power driving source, in a conventional manner, not shown.

The shogging lever 28 is provided with a plurality of notches 68, 70 and 72 which are adapted to receive keying element 74 therein. Keying element 74 is preferably in the form of a small block and rests within the notches 68, 70 or 72. Keying element 74 is provided with a pivot axis 76 which has one end of rods 78 and 80 pivotable thereabout. The other end of rods 78 and 80 are provided with pivoting axis 82 and 84, respectively which has coupled therein slider bars 86 and 88, respectively, which extend into channels 90 and 92 provided in the housing 94 of the guidebar shogging guide apparatus 10. Slider bars 86 and 88 are provided with a direction of motion indicated by arrows 96. Pivot point 76 lies on a straight line connecting the central point of pivot axis 34 and is central point of ball joint 32.

Figure 2:
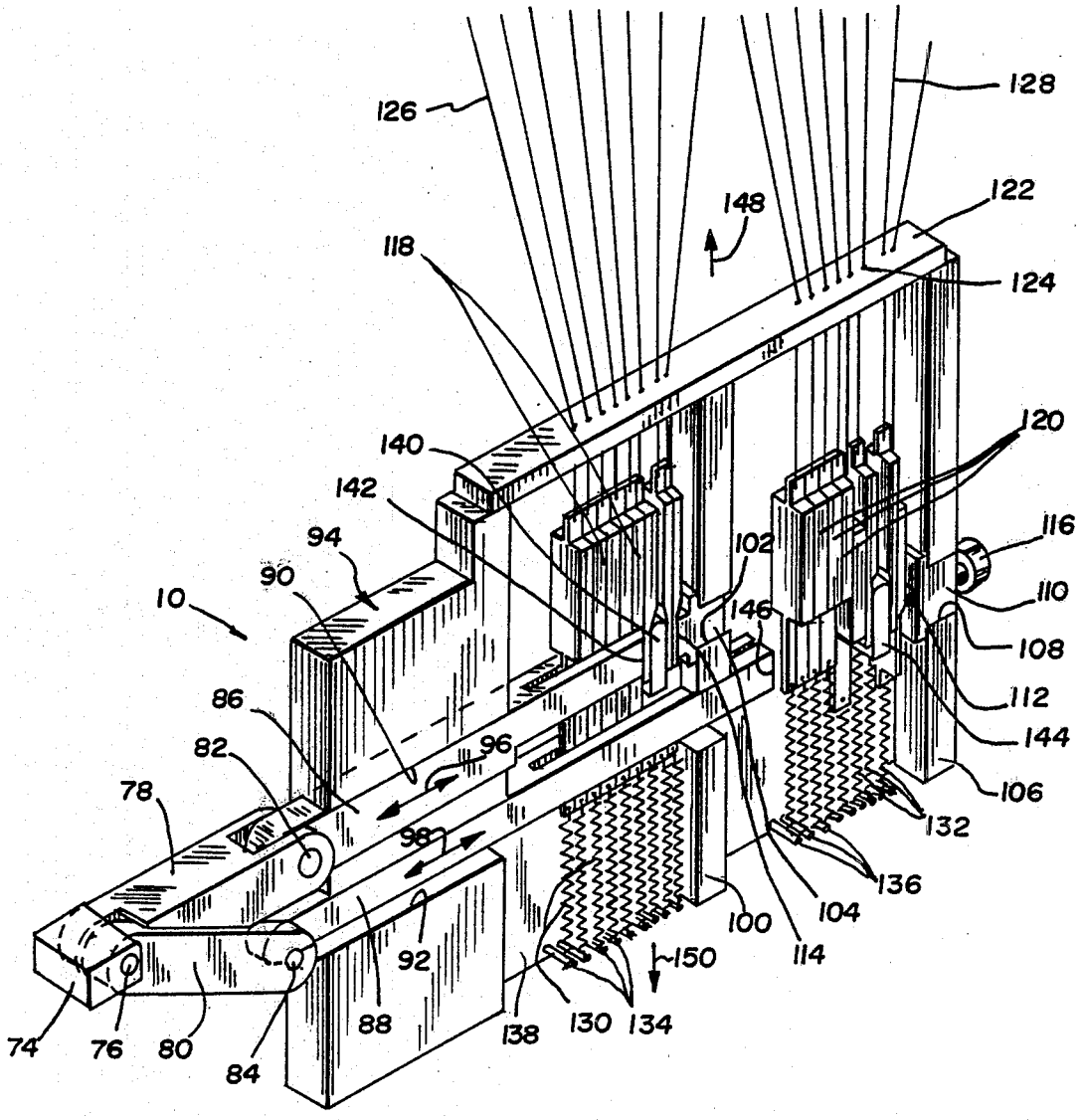
FIG. 2 is a perspective view of a pair of guide apparatuses utilized with two slider bars of the present invention.

The shogging guide apparatus is illustrated in more detail in FIG. 2 and is shown to include two channels 90 and 92 which slidable receive slider bars 86 and 88 respectively therein, for movement in a longitudinal direction as indicated by arrows 96 and 98.

The housing 94 preferably includes a first vertically transverse wall 100 which is provided with an opening 102 that is adapted to receive stop block 104 that functions as a striker plate or impact surface for the slider bar 86. A second transverse wall 106 is provided at the rear of housing 94 and includes an opening 108 adapted to receive stop block 110 therein. Stop block 110 includes flat surface 112, which functions as a fixed stop or impact surface for slider bar 88, as will be explained hereinafter. Stop block 110 functions in the same manner as stop block 104 and its associated impact surface 114. The stop block 110 further includes an adjustment screw 116 which may be used to position the impact surface 112 and align its position with respect to slider 88 so that it is in the same position as impact surface 114 with respect to slider 86, thereby positioning keying element 74 in the exact same position for the corresponding identical positions of the setting elements 118, that cooperate with slider bar 86, with the setting elements 120 that cooperate with slider bar 88.

The top or cover 122 of housing 94 is provided with a plurality of apertures 124 to permit the passage therethrough of a plurality of harness strings 126 and 128 from a conventional jacquard mechanism, not shown. Harness strings 126 are connected to setting elements 118 and are utilized to move the setting elements out of their normal rest position which is accomplished by the use of return springs 130. Harness strings 128 are affixed to setting elements 120, in a conventional manner, and are utilized to position setting elements 120 out of their rest position which is maintained by the use of return springs 132 affixed to the opposite ends of the setting elements 120 in exactly the same manner as springs 130 are affixed to the opposite ends of setting elements 118. The springs 130 and 132 are preferably maintained in position by having their far ends affixed to pegs 134 and 136, respectively, fixed to a vertical longitudinal rear wall 138. Intermediate or stationary setting element 140 is adapted to cooperate with slider bar 86 and is provided with its own return spring 134 but is not provided with a harness string coupled to the jacquard mechanism so that it is always maintained in a fixed position in line with the impact surface and the end 142 of slider bar 86. A similar stationery element 144 is provided in line with impact surface 112, is maintained in position by its own return spring 132 and is kept in line with the end 146 of slider bar 88. Stationery element 144 is not provided with a harness string since it is always maintained in the same position.

As disclosed, the guidebar shogging guide apparatus appearing in the housing 94 is repeated twice permitting the utilization of either slider bar 86 or slider bar 88. Thus, since slider bar 86 alternates with slider bar 88 to position key element 74 it permits the resetting of one group of shogging guide setting elements 118 while the other group of shogging guide setting elements 120 is being utilized to control the position of the slider bar, thereby permitting the warp knitting machine to operate at much faster speeds, since no time is lost in waiting for the resetting of the shogging guide elements.

Each of the setting elements 118 is provided with its own harness string 126 and its own return spring 130 except the stationery setting element 140, so that any program set in the jacquard mechanism which activates harness strings 126 can, in accordance with the predetermined program set into the jacquard mechanism, adjust the incremental spacing for deflection of the guidebar by positioning the setting elements 118 from its normal rest or return position to its activated position which would remove them from coming into the impact path of the slider bar, stationery element 140, and impact surface 114. The same operation would follow for slider bar 88 and setting elements 120 utilized with stationery element 144 at contact surface 112.

For further information relating to the operation of the setting elements 118 and 120 and their operation, reference may be had to U.S. patent application Ser. No. 165,040, filed on July 1, 1980, entitled: "Guidebar Shogging Guide Apparatus for Warp Knitting Machines."

In operation, the present invention provides for overcoming shortcomings found in the prior art by providing a keying element 74 in intimate contact with the shogging lever 28. The other end of the keying element 74 is pivotally connected by means of levers 78 and 80 to slider bars 86 and 88, respectively. With this construction, when the alternating drive mechanism 14 brings the keying element 74 into contact with the extension of the slider, because of the eccentric movement of cam 46 and pushrod 50 acting on connecting rod 36, the appropriate lever, 78 or 80 is stretched in the longitudinal direction so that the other end of the slider bar 86 or 88 is pressed against the adjustable stop surface 112 or 114. At the same time as this is occurring, the other lever is positioned at such an angle that the other slider bar must be pulled away from its adjustable stop. The position of the slider bars reverse when the keying element finds itself with the slider having its associated lever fully extended. This arrangement has the definite advantage that the slider bars need not be required to overcome a spring return force, therefore, no locking mechanism is necessary and no drive force is necessary for guiding the slider elements. Thus, the present construction is greatly simplified over those known heretofore. The guide or steering mechanism carries substantially no load and may very readily be readjusted to its new position by the jacquard mechanism. In order to transfer from one keyed position to the next, the entire energy of the alternating drive means 44 is available since no spring control devices must be overcome. Moreover, the inevitable oscillations associated with the rolling contact as described in the prior art device, are eliminated. Therefore, with the present construction of the guidebar shogging linkages, it is possible to operate the warp knitting machine at much higher speeds than heretofore possible.

As mentioned earlier, in the adjustment from one keying setting to another along the length of the shogging lever 28, in addition to the displacement caused by the adjustable setting elements, a further small, superimposed displacement occurs because of the swinging movements of the levers. Generally, because of the minimal movement involved, it can be ignored. However, in high speed warp knitting machines even the smallest displacements can be harmful. Therefore, it is desirable to make the pivoting axis 34 of the shogging lever movable backwards and forwards by means of a compensating drive mechanism 54. Utilizing this type of compensating drive mechanism, the additional displacement can be almost completely eliminated.

Heretofore has been disclosed a reliable, simple guidebar shogging linkage arrangement that is capable of compensating for variation in the needle spacing on a needle bar and a means for correcting the small displacement which is introduced by the swinging movement of the levers. The linkage is adaptable for use with units of varying needle spacings on the needle bar with a minimal amount of adjustment to the apparatus. It will be understood that various changes to the details, materials, arrangement of parts and operating conditions which have been herein described and illustrated in order to explain the nature of the invention may be made by those skilled in the art within the principles and scope of the present invention.

Having thus set forth the nature of the invention, what is claimed is:

1. A guidebar shogging linkage arrangement for warp knitting machines having a guide bar, a needle bar with a plurality of equally spaced needles disposed thereon, a shogging guide apparatus for shogging said guidebar in predetermined increments parallel to said needle bar, and a power driving source operatively coupled thereto, comprising in combination:

(a) a pair of guide means, each of said guide means having means for providing a predetermined incremental distance in a longitudinal direction;

(b) a pair of slider bars, each of said slider bars being mounted in the longitudinal direction and operatively coupled to one of said pair of guide means, the position of each said slider bar in longitudinal direction being determined by said guide means being set to a particular distance according to a predetermined program, (c) shogging lever means operatively coupled to said guidebar for moving said guidebar in a direction parallel to said needle bar, (d) first and second elongated lever means, one end of said first lever being pivotably connected to one of said slider bars, one end of said second lever means being pivotably connected to the other of said slider bars, (e) keying element means positioned in intimate contact with said shogging lever means having a pivot hinge means adapted to pivotably retain the other ends of said first and second lever means about a common axis, said shogging lever means being driven by said power driving source with its position alternately related to the longitudinal position of said first and second slider bar.

2. A guidebar shogging linkage arrangement according to claim 1 wherein said shogging lever means is provided with adjustment means for changing the amount of incremental shogging distance said guide-bar is moved for the same incremental setting of said guide means.

3. A guidebar shogging linkage arrangement according to claim 2 wherein said shogging adjustment means includes a plurality of detents provided at predetermined distances from the pivoting axis of sais shogging lever means.

4. A guidebar shogging linkage arrangement according to claim 1 further including a compensating drive means operatively coupled to said power driving source for moving the pivot axis of said shogging lever means backwards and forwards in a direction substantially parallel to the direction of travel of said slider bars.

5. A guidebar shogging linkage arrangement according to claim 1 further including a first compensating drive means operatively coupled to said power driving source for moving the pivot axis of said shogging lever means backwards and forwards in a direction substantially parallel to the direction of travel of said slider bars by a connecting rod having one end pivotably connected to said shogging lever pivot axis, the other end of said connecting rod being connected to a support lever disposed substantially perpendicular to said connecting rod, said connecting rod also being pivotably connected along its length to an alternating drive means for moving said shogging lever pivot axis substantially perpendicular to the movement of said slider bars.

* * * * *